US006824733B2

(12) United States Patent
Erickson et al.

(10) Patent No.: US 6,824,733 B2
(45) Date of Patent: Nov. 30, 2004

(54) MELTBLOWING APPARATUS EMPLOYING PLANETARY GEAR METERING PUMP

(75) Inventors: Stanley C. Erickson, Scandia, MN (US); James C. Breister, Oakdale, MN (US); Michael G. Schwartz, Hugo, MN (US); Patrick J. Sager, Hastings, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 330 days.

(21) Appl. No.: 10/177,419

(22) Filed: Jun. 20, 2002

(65) Prior Publication Data

US 2003/0234463 A1 Dec. 25, 2003

(51) Int. Cl.[7] ..... D01D 5/088; D01D 13/00; D04H 3/00

(52) U.S. Cl. ..... 264/555; 264/103; 425/72.2; 425/382.2; 425/463

(58) Field of Search ..... 264/103, 555; 425/72.2, 382.2, 463

(56) References Cited

U.S. PATENT DOCUMENTS

| | | | |
|---|---|---|---|
| 3,498,230 | A | 3/1970 | Schippers |
| 3,502,033 | A | 3/1970 | Kaczorowski |
| 3,571,679 | A | 3/1971 | Van Turnhout |
| 3,971,373 | A | 7/1976 | Braun |
| 4,111,531 | A | 9/1978 | Lavelle et al. |
| 4,215,682 | A | 8/1980 | Kubik et al. |
| 4,889,476 | A | 12/1989 | Buehning |
| 4,995,333 | A | 2/1991 | Keller et al. |
| 5,124,111 | A | 6/1992 | Keller et al. |
| 5,236,641 | A | 8/1993 | Allen et al. |
| 5,248,247 | A | 9/1993 | Rübhausen et al. |
| 5,260,003 | A | 11/1993 | Nyssen et al. |
| 5,354,529 | A | 10/1994 | Berger et al. |
| 5,458,291 | A | 10/1995 | Brusko et al. |
| 5,582,907 | A | 12/1996 | Pall |
| 5,605,720 | A | 2/1997 | Allen et al. |
| 5,636,790 | A | 6/1997 | Brusko et al. |
| 5,637,331 | A | 6/1997 | Lenk et al. |
| 5,728,407 | A | 3/1998 | Matsui |
| 5,863,485 | A | 1/1999 | Groleau |
| 5,863,565 | A | 1/1999 | Rossillon et al. |
| 5,891,482 | A | 4/1999 | Choi |

(List continued on next page.)

FOREIGN PATENT DOCUMENTS

| | | | |
|---|---|---|---|
| DE | 29 33 025 | A1 | 3/1981 |
| EP | 0 363 317 | A2 | 4/1990 |
| EP | 0 417 815 | B2 | 3/1991 |
| GB | 870019 | A | 6/1961 |
| WO | WO 9932692 | A1 | 7/1999 |

OTHER PUBLICATIONS

"Biax Introduces the HT–Series,"[online] Biax–Fiberfilm Corporation, Greenville, WI [retrieved on Feb. 12, 2001]. Retrieved from the Internet <URL: http://www.execpc.com/biax/products.htm>; 2 pages.

(List continued on next page.)

*Primary Examiner*—Leo B. Tentoni
(74) *Attorney, Agent, or Firm*—Karl G. Hanson; David R. Cleveland

(57) ABSTRACT

Melt blown nonwoven webs are formed by supplying fiber-forming material to a planetary gear metering pump having a plurality of outlets, flowing fiber-forming material from the pump outlets through a plurality of inlets in one or more die cavities, and meltblowing the fiber-forming material. Each die cavity inlet receives a fiber-forming material stream having a similar thermal history. The physical or chemical properties of the nonwoven web fibers such as their average molecular weight and polydispersity can be made more uniform. Wide nonwoven webs can be formed by arranging a plurality of such die cavities in a side-by-side relationship. Thicker or multilayered nonwoven webs can be formed by arranging a plurality of such die cavities atop one another.

43 Claims, 9 Drawing Sheets

U.S. PATENT DOCUMENTS

| | | | |
|---|---|---|---|
| 5,902,531 | A | 5/1999 | Berger et al. |
| 5,951,942 | A | 9/1999 | Rossillon et al. |
| 5,993,943 | A | 11/1999 | Bodaghi et al. |
| 6,057,256 | A | 5/2000 | Krueger et al. |
| 6,182,732 | B1 | 2/2001 | Allen |
| 6,296,463 | B1 | 10/2001 | Allen |

OTHER PUBLICATIONS

"Diagram (of Biax melt blown system), "[online] Biax–Fiberfilm Corporation, Greenville, WI [retrieved on Feb. 12, 2001]. Retrieved from the Internet <URL: http://www.execpc.com/~biax/products.htm>; 1 page.

"Metering Pumps—Planetary Polymer Metering Pumps," [online] Slack & Parr Ltd., Kegworth, Derby, England [retrieved on Feb. 12, 2001]. Retrieved from the Internet <URL: http://www.slackandparr.com/meter_pumps/polymer.htm>; 1 page.

Mahr GmbH, Göttingen, Germany "Feinpruef Spinning Pumps, Spin Finsih Metering Pumps and Test Stands," Feb. 2, 2000; 12 pages.

"Planetary Melt Spinning Pumps," Barmag SauerGroup, Sauer Inc., Charlotte, NC [retrived on Feb. 12, 2001]. Retrieved from the Internet <URL: http://www.barmag.com/e_products_planetary _pumps.htm>; 2 pages.

"Spinning Pumps," Mahr GmbH, Göttingen, Germany [undated] 6 pages.

"Zenith® Is Your Partner For Increased Uptime, Improved Denier Uniformity, And Reduced Maintenance," [online] Parker Hannifin Corporation, Zenith Products Division, Sanford, NC [retrieved on Feb. 12, 2001]. Retrieved from the Internet <URL: http://www.zenithpumps.com/applications/fiber.htm>; 2 pages.

"Zenith® Pumps, Planetary Gear Pumps, Installation, Care and Maintenance," Parker Hannifin Corporation, Zenith Pumps Division, Sanford, NC, copyright 1996.

"Zenith® Pumps, Planetary Gear Pumps, Precise, Pulseless, Repeatable Performance in Hot Melt Spin Pump Application," Parker Hannifin Corporation, Zenith Pumps Division, Sanford, NC, copyright 1998.

MELTBLOWING APPARATUS EMPLOYING PLANETARY GEAR METERING PUMP

FIELD OF THE INVENTION

This invention relates to devices and methods for preparing melt blown fibers.

BACKGROUND

Nonwoven webs typically are formed using a meltblowing process in which filaments are extruded from a series of small orifices while being attenuated into fibers using hot air or other attenuating fluid. The attenuated fibers are formed into a web on a remotely-located collector or other suitable surface. A spun bond process can also be used to form nonwoven webs. Spun bond nonwoven webs typically are formed by extruding molten filaments from a series of small orifices, exposing the filaments to a quench air treatment that solidifies at least the surface of the filaments, attenuating the at least partially solidified filaments into fibers using air or other fluid and collecting and optionally calendaring the fibers into a web. Spun bond nonwoven webs typically have less loft and greater stiffness than melt blown nonwoven webs, and the filaments for spun bond webs typically are extruded at lower temperatures than for melt blown webs.

There has been an ongoing effort to improve the uniformity of nonwoven webs. Web uniformity typically is evaluated based on factors such as basis weight, average fiber diameter, web thickness or porosity. Process variables such as material throughput, air flow rate, die to collector distance, and the like can be altered or controlled to improve nonwoven web uniformity. In addition, changes can be made in the design of the meltblowing or spun bond apparatus. References describing such measures include U.S. Pat. Nos. 4,889,476, 5,236,641, 5,248,247, 5,260,003, 5,582,907, 5,728,407, 5,891,482 and 5,993,943.

An extruder and one or more metering gear pumps generally are used to supply fiber-forming material to a meltblowing die. The gear pump typically has two counter-rotating meshed gears. Wide melt blown nonwoven webs have been formed by arranging a plurality of meltblowing dies in a side-by-side array, and by using a plurality of such gear pumps to deliver molten polymer to the array of dies, see U.S. Pat. Nos. 5,236,641 and 6,182,732. The '641 patent utilizes sensors and a feedback system to measure a physical property (e.g., thickness or basis weight) of strips of the web, and then alters the speeds of the gear pumps to maintain uniformity of the selected property within the strips or across the width of the web.

Despite many years of effort by various researchers, fabrication of commercially suitable nonwoven webs still requires careful adjustment of the process variables and apparatus parameters, and frequently requires that trial and error runs be performed in order to obtain satisfactory results. Fabrication of wide melt blown nonwoven webs with uniform properties can be especially difficult.

SUMMARY OF THE INVENTION

Figure 1:
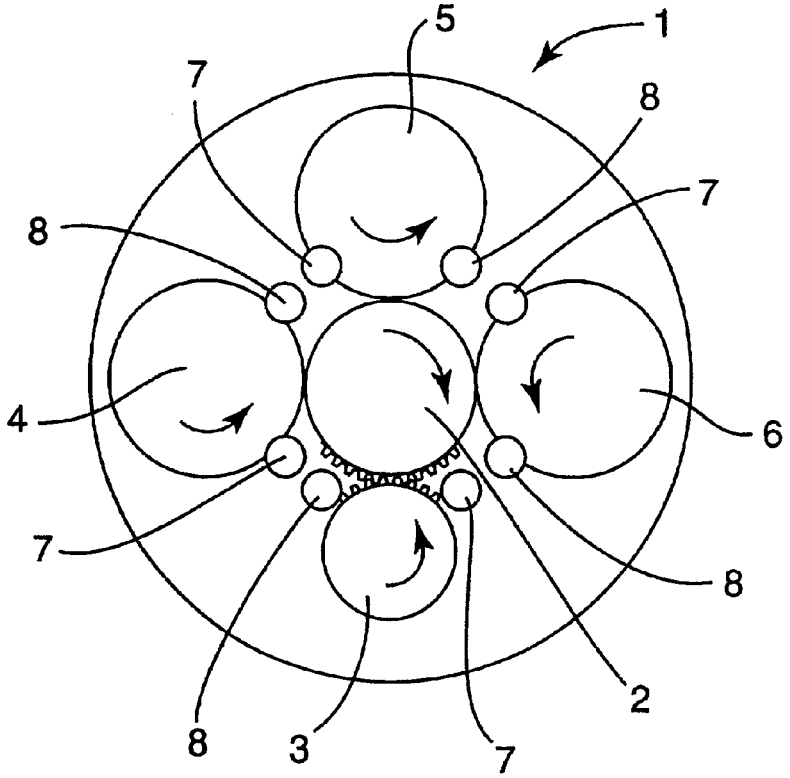
FIG. 1 is a schematic top sectional view of a planetary gear metering pump.

Meltblowing requires particularly high temperatures. These high temperatures can be very hard on meltblowing dies and other associated equipment, including the above-described gear pumps. Occasionally pump breakdowns will occur. Periodic pump maintenance is required in any event. When a set of gear pumps is employed, it is difficult to maintain them so that they all have the same tolerances and operating conditions. For these and other reasons it can be very difficult to obtain uniform nonwoven webs in a factory setting, especially when forming wide melt blown nonwoven webs using a multiple metering pump system, and whether or not a pump feedback system is employed.

Although useful, macroscopic nonwoven web properties such as basis weight, average fiber diameter, web thickness or porosity may not always provide a sufficient basis for evaluating nonwoven web quality or uniformity. These macroscopic web properties typically are determined by cutting small swatches from various portions of the web or by using sensors to monitor portions of a moving web. These approaches can be susceptible to sampling and measurement errors that may skew the results, especially if used to evaluate low basis weight or highly porous webs. In addition, although a nonwoven web may exhibit uniform measured basis weight, fiber diameter, web thickness or porosity, the web may nonetheless exhibit nonuniform performance characteristics due to differences in the intrinsic properties of the individual web fibers. Meltblowing subjects the fiber-forming material to appreciable viscosity reduction (and sometimes to considerable thermal degradation), especially during pumping of the fiber-forming material to the meltblowing die and during passage of the fiber-forming material through the die. A more uniform web could be obtained if each stream of fiber-forming material delivered to a meltblowing die cavity or array of such die cavities had the same or substantially the same physical or chemical properties as it entered the die cavity or array. Uniformity of such physical or chemical properties can be facilitated by subjecting the fiber-forming material streams to the same or substantially the same pumping conditions, thereby exposing the fiber-forming material to a more uniform thermal history before it reaches the die or array. The extruded filaments that later exit the die or array may have more uniform physical or chemical properties from filament to filament, and after attenuation and collection may form higher quality or more uniform melt blown nonwoven webs.

The desired filament physical property uniformity preferably is evaluated by determining one or more intrinsic physical or chemical properties of the collected fibers, e.g., their weight average or number average molecular weight, and more preferably their molecular weight distribution. Molecular weight distribution can conveniently be characterized in terms of polydispersity. By measuring properties of fibers rather than of web swatches, sampling errors are reduced and a more accurate measurement of web quality or uniformity can be obtained.

The present invention provides, in one aspect, a method for forming a fibrous web comprising supplying fiber-forming material to a planetary gear metering pump having a plurality of outlets, flowing fiber-forming material from the pump outlets through a plurality of inlets in one or more die cavities, and meltblowing the fiber-forming material to form a nonwoven web. In a preferred embodiment, the method employs a plurality of such die cavities arranged to provide a wider or thicker web than would be obtained using only a single such die cavity.

In another aspect, the invention provides a meltblowing apparatus comprising a planetary gear metering pump having a plurality of fiber-forming material outlets connected to a plurality of fiber-forming material inlets in one or more die cavities of one or more meltblowing dies. In a preferred embodiment, the meltblowing die comprises a plurality of die cavities arranged to provide a wider or thicker web than would be obtained using only a single such die cavity.

DETAILED DESCRIPTION

As used in this specification, the phrase "nonwoven web" refers to a fibrous web characterized by entanglement, and preferably having sufficient coherency and strength to be self-supporting.

The term "meltblowing" means a method for forming a nonwoven web by extruding a fiber-forming material through a plurality of orifices to form filaments while contacting the filaments with air or other attenuating fluid to attenuate the filaments into fibers and thereafter collecting a layer of the attenuated fibers.

The phrase "meltblowing temperatures" refers to the meltblowing die temperatures at which meltblowing typically is performed. Depending on the application, meltblowing temperatures can be as high as 315° C., 325° C. or even 340° C. or more.

The phrase "meltblowing die" refers to a die for use in meltblowing.

The phrase "melt blown fibers" refers to fibers made using meltblowing. The aspect ratio (ratio of length to diameter) of melt blown fibers is essentially infinite (e.g., generally at least about 10,000 or more), though melt blown fibers have been reported to be discontinuous. The fibers are long and entangled sufficiently that it is usually impossible to remove one complete melt blown fiber from a mass of such fibers or to trace one melt blown fiber from beginning to end.

The phrase "attenuate the filaments into fibers" refers to the conversion of a segment of a filament into a segment of greater length and smaller diameter.

The term "polydispersity" refers to the weight average molecular weight of a polymer divided by the number average molecular weight of the polymer, with both weight average and number average molecular weight being evaluated using gel permeation chromatography and a polystyrene standard.

The phrase "fibers having substantially uniform polydispersity" refers to melt blown fibers whose polydispersity differs from the average fiber polydispersity by less than ±5%.

The phrase "shear rate" refers to the rate in change of velocity of a nonturbulent fluid in a direction perpendicular to the velocity. For nonturbulent fluid flow past a planar boundary, the shear rate is the gradient vector constructed perpendicular to the boundary to represent the rate of change of velocity with respect to distance from the boundary.

The phrase "residence time" refers to the flow path of a fiber-forming material stream through a die cavity divided by the average stream velocity.

The phrase "substantially uniform residence time" refers to a calculated, simulated or experimentally measured residence time for any portion of a stream of fiber-forming material flowing through a die cavity that is no more than twice the average calculated, simulated or experimentally measured residence time for the entire stream.

Referring now to FIG. 1, planetary gear metering pump 1 employs a so-called planetary or epicyclic gearset inside the pump. A rotating driving or sun gear 2 is surrounded by and engaged with a plurality of driven or planet gears 3 through 6. Fiber-forming material (supplied using, e.g., an extruder) enters the spaces between the driving and driven gear teeth via inlets 7 and upon rotation of the driving gear 2 and its associated driven gears 3 through 6 is pumped out of pump 1 via outlets 8.

Figure 2:
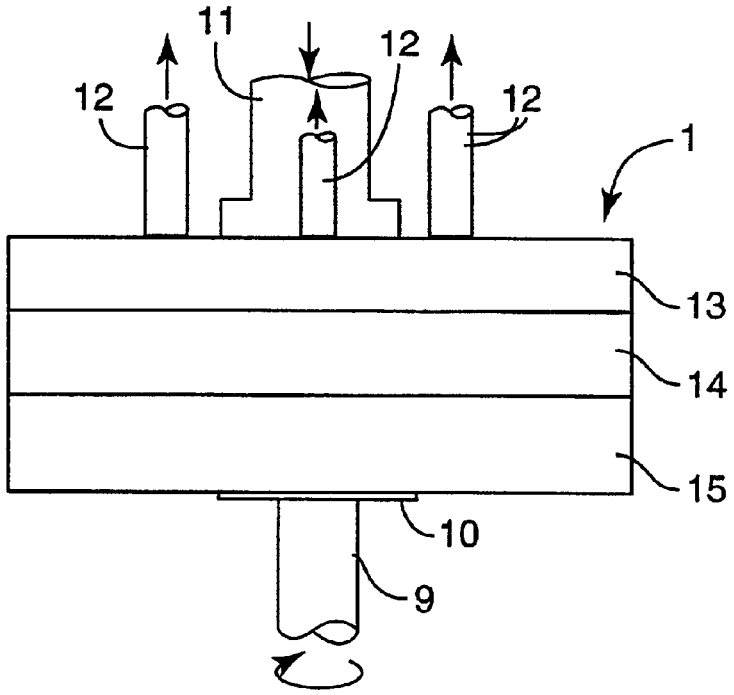
FIG. 2 is a schematic side view of a planetary gear metering pump.

FIG. 2 shows a side view of pump 1 of FIG. 1. Rotating driveshaft 9 passes through seal 10 into the interior of pump 1. Fiber-forming material enters pump 1 through inlet port 11, and exits pump 1 through outlets such as outlets 12. To facilitate cleaning of pump 1 and replacement or worn parts, the body of pump 1 may be made from a plurality of machined plates such as plates 13 through 15. An important advantage of a planetary gear metering pump such as pump 1 over a conventional gear pump is that the individual output streams have very similar flow rates and undergo very similar thermal history in each stream.

A variety of planetary gear metering pumps may be employed in the invention. The pump preferably should withstand exposure to fiber-forming material at meltblowing temperatures. For some meltblowing applications this will require a relatively robust planetary gear metering pump capable of operating at temperatures as high as 350° C., and may require special pump materials and hardened components. Suitable planetary gear metering pumps may have a variety of configurations, with, for example 2, 3, 4, 6, 8 or more outlets per pump, and with various arrangements of the inlet and outlet ports on one or two sides of the pump. If desired, the pumps can employ static mixer elements at or near one or both of the pump inlet and pump outlet. Use of such static mixers can facilitate mixing and distribution of the fiber-forming material. Preferred planetary gear metering pumps are described in, for example. "Feinpruef Spinning Pumps" (brochure from Mahr GmbH; The "F 16" alloy Feinpruef pumps are particularly preferred); "Planetary Polymer Metering Pumps" (web page of Slack & Parr, Ltd.); "Zenith® Pumps Planetary Gear Pumps" (brochure from the Zenith Pumps Division of Parker Hannifin Corporation).

More general disclosure of planetary gear metering pumps can be found in, for example, U.S. Pat. Nos. 3,498.230; 5,354,529; 5,637,331 and 5,902,531; and U.K. Patent No. 870,019. As described in several of these brochures and patents, planetary gear metering pumps have been used to deliver molten polymer to manifolds feeding spinnerets in melt-spun fiber manufacturing processes. The melt-spun fiber manufacturing process typically involves lower temperatures than are used for manufacturing nonwoven webs, and especially for meltblowing nonwoven webs. For example, in meltblowing the fiber-forming material exiting the die outlet typically has a much higher temperature, a much lower molecular weight and a significantly lower viscosity than molten material exiting a melt-spun die. In meltblowing, the extruded fibers are attenuated in thickness (and thereby lengthened in the extrusion direction) by the action of a high velocity air stream. In melt-spinning, an attenuating air stream typically is not employed. In meltblowing, the fiber-forming material may be significantly chinned or even thermally degraded by passage through the pumps, by passage through the meltblowing die, by the high temperatures required to reach the desired low melt viscosity or by the stream of air or other attenuating fluid. In melt-spinning, the extent of thinning or thermal degradation is believed to be much less extensive. The temperatures and forces associated with meltblowing thus tend to magnify nonuniformities in the final nonwoven product, especially when there are differences in the fiber-forming material thermal history at various pans of the meltblowing process. The fiber product obtained by melt-spinning is believed to be much more uniform.

Use of a planetary gear metering pump to supply one or more meltblowing dies may help reduce variation in the collected product, because the pump supplies each fiber-forming material inlet in a die or array of dies with a fiber-forming material stream having a similar flow rate and thermal history. Because the nature of the melt-blown process magnifies any differences that may be present in the fiber-forming material supply streams, the use of a planetary gear metering pump can provide product uniformity advantages that might not be observed or might not be significant in melt-spun fiber manufacturing.

Figure 3:
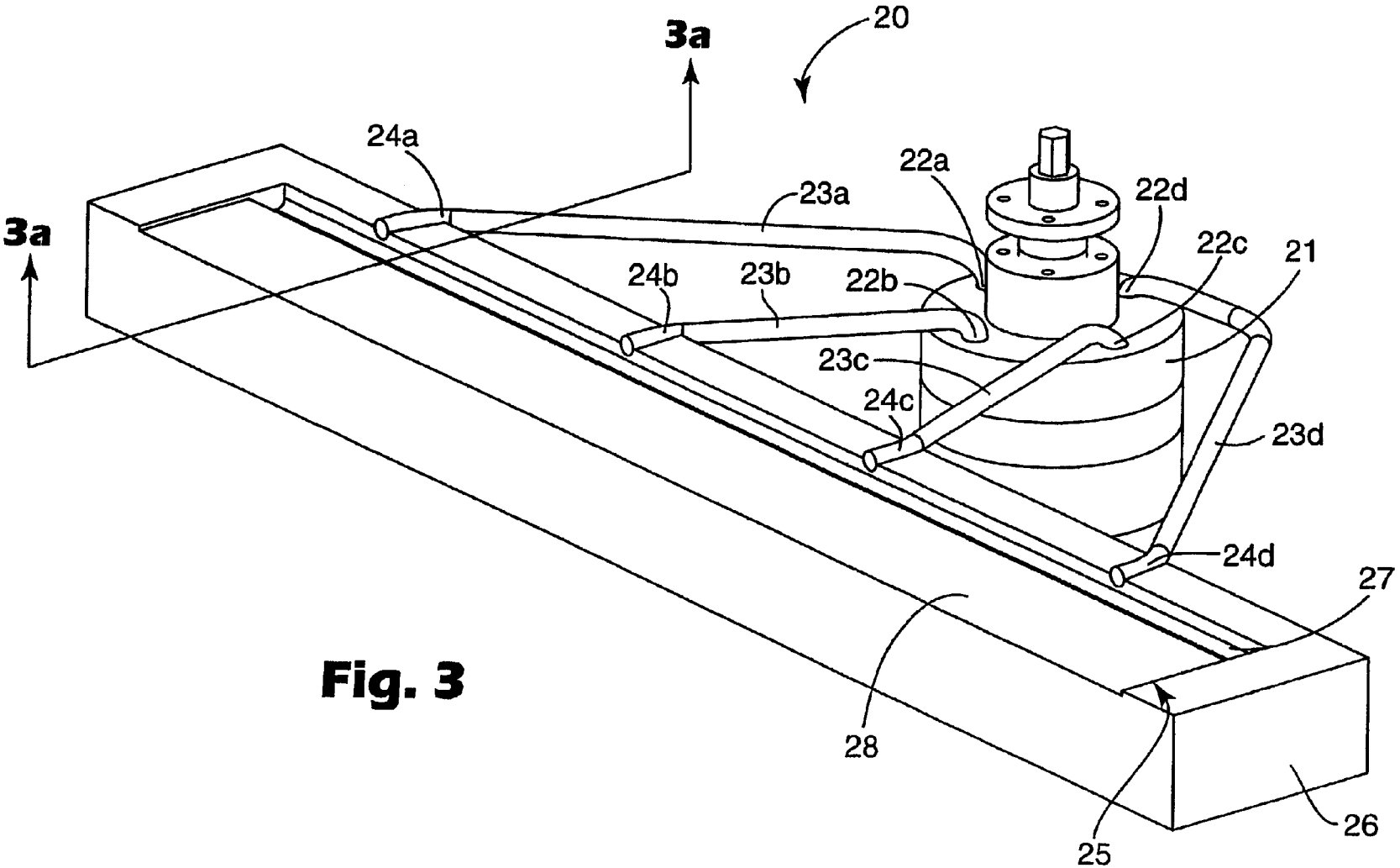
FIG. 3 is a schematic perspective view, partially in section, of a meltblowing die incorporating a planetary gear metering pump and a multiple-inlet tee slot meltblowing die cavity.

FIG. 3 shows a meltblowing apparatus 20 of the invention that includes a planetary gear metering pump 21 whose four outlets 22*a* through 22*d* supply fiber-forming material via conduits 23*a* through 23*d* to inlets 24*a* through 24*d* of tee slot die cavity 25 in die body 26. Die cavity 25 includes manifold 27 and slot 28.

Figure 3A:
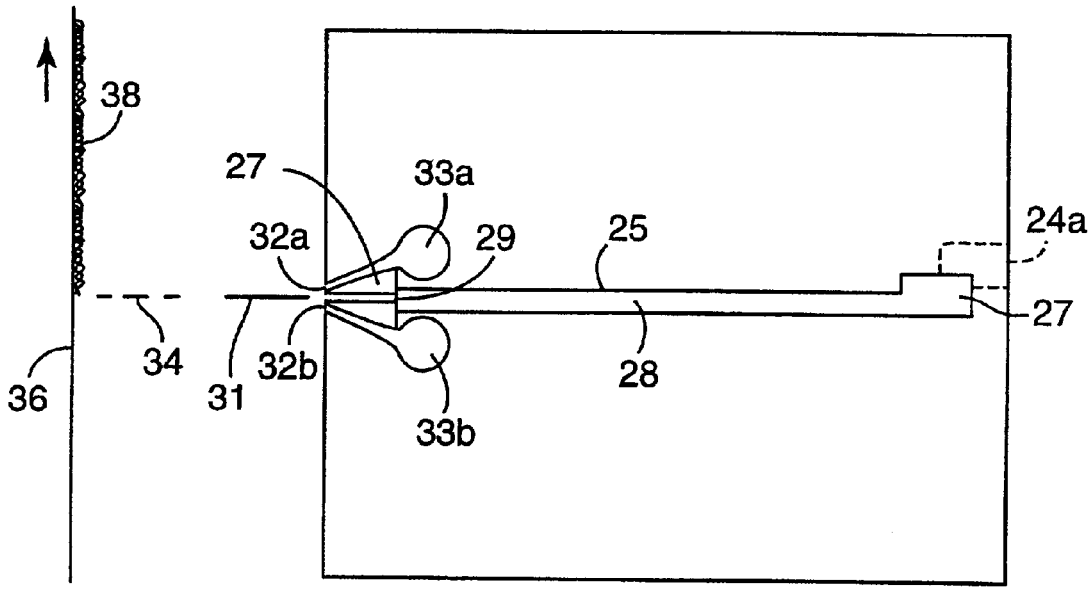
FIG. 3*a* is a schematic side view of the outlet region of the meltblowing die of FIG. 3, taken along the line 3*a*–3*a'*.

FIG. 3*a* is sectional side view of the outlet region of die cavity 25 of FIG. 3, taken along the line 3*a*–3*a*'. As shown in FIG. 3*a*, the fiber-forming material (which undergoes considerable heat-induced viscosity reduction or even thermal degradation and usually a molecular weight change due to passage through the die cavity) exits die cavity 25 at die tip 27 through a row of side-by-side orifices such as orifice 29 drilled or machined in die tip 27 to produce a series of filaments 31. High velocity attenuating fluid (e.g., air) is supplied under pressure to orifices such as orifices 32*a* and 32*b* from plenums 33*a* and 33*b* adjacent die tip 27. The fluid attenuates the filaments 31 into elongated and reduced diameter fibers 34 by impinging upon, drawing down and possibly tearing or separating the filaments 31. The fibers 34 are collected at random on a remotely-located collector such as a moving screen 36 or other suitable surface to form a coherent entangled nonwoven web 38. The fiber-forming material streams delivered to inlets 24*a* through 24*d* of die cavity 25 all have a similar thermal history, thus promoting the formation of fibers 34 having substantially uniform fiber physical or chemical properties. Further details regarding the manner in which meltblowing would be carried out with such an apparatus can be found, for example, in Wente, Van A., "Superfine Thermoplastic Fibers" in Industrial Engineering Chemistry, Vol. 48, p. 1342 et seq. (1956), or in Report No. 4364 of the Naval Research Laboratories, published May 25, 1954, entitled "Manufacture of Superfine Organic Fibers," by Wente, V. A.; Boone, C, D.; and Fluharty, E. L.

Figure 4:
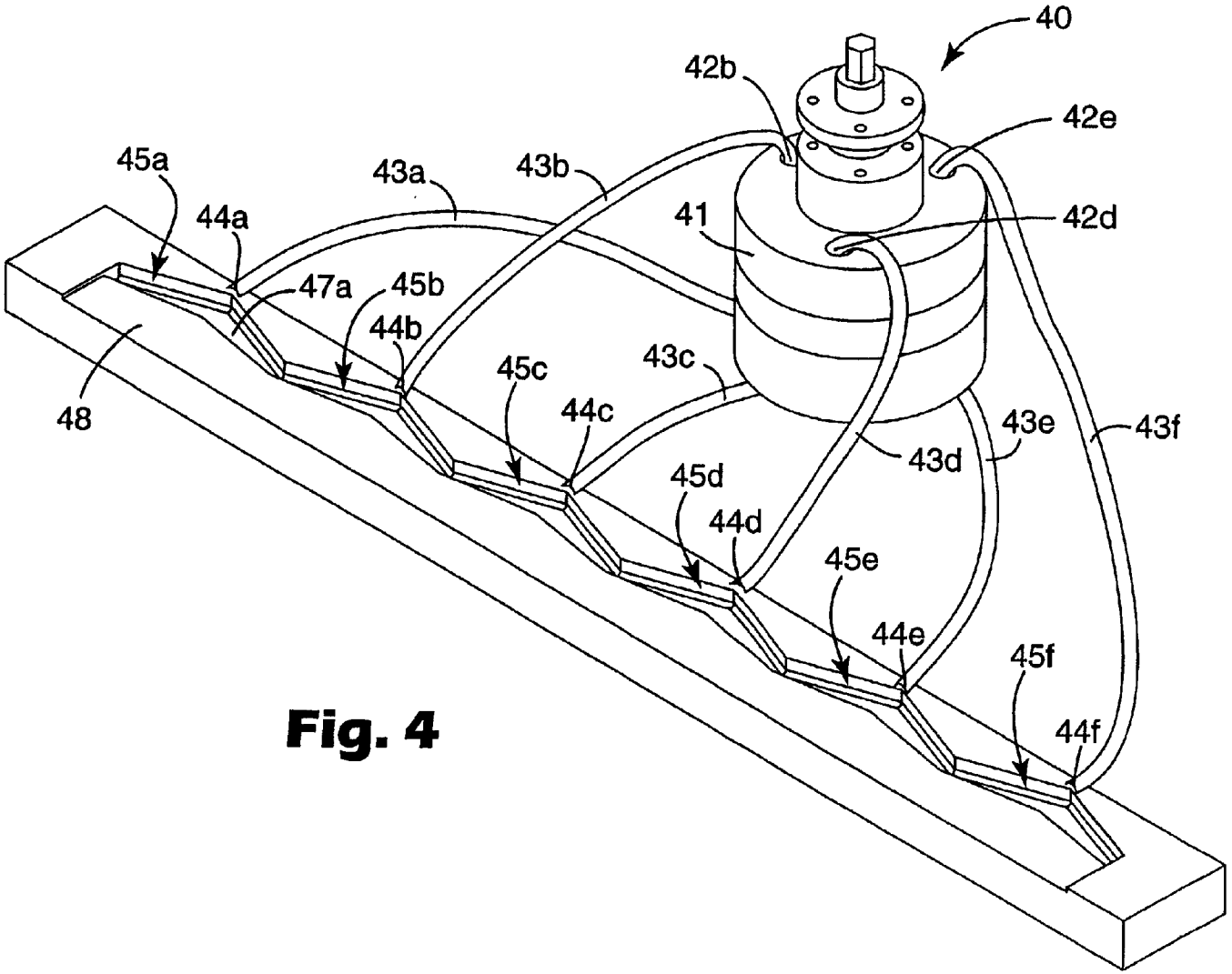
FIG. 4 is a schematic perspective view, partially in section, of a meltblowing die incorporating a planetary gear metering pump and an array of fish tail meltblowing die cavities in a side-by-side relationship.

FIG. 4 shows a meltblowing apparatus 40 of the invention that includes a planetary gear metering pump 41 whose three outlets 42*b*, 42*d* and 42*f* located on the top of pump 41 and three further outlets located at the bottom of pump 41 (not shown in FIG. 4) supply fiber-forming material via conduits 43*a* through 43*f* to inlets 44*a* through 44*f* of an array of six fish tail die cavities 45*a* through 45*f* arranged in a side-by-side relationship in die body 46. Each fish tail die includes a manifold such as manifold 47*a*. The dies share a common slot 48. The fiber-forming material streams delivered to the inlets 44*a* through 44*f* of meltblowing die cavities 45*a* through 45*f* all have a similar thermal history, thus promoting the formation of a nonwoven web of entangled fibers having substantially uniform fiber physical or chemical properties on a moving collector (not shown in FIG. 4).

Figure 5:
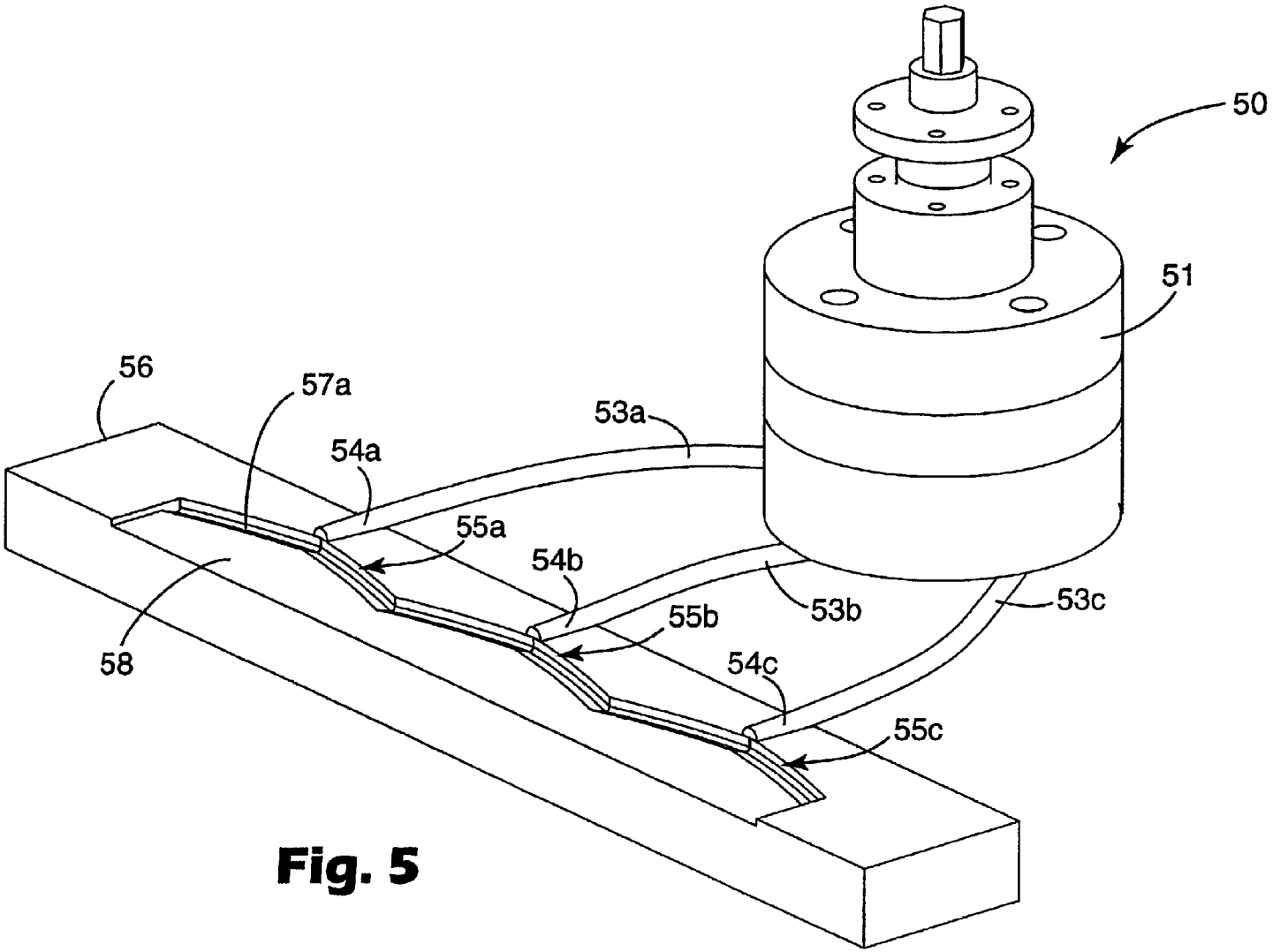
FIG. 5 is a schematic perspective view, partially in section, of a meltblowing die incorporating a planetary gear metering pump and an array of coathanger meltblowing die cavities in a side-by-side relationship.

FIG. 5 shows a meltblowing apparatus 50 of the invention that includes a planetary gear metering pump 51 whose three outlets located at the bottom of pump 51 (not shown in FIG. 5) supply fiber-forming material via conduits 53*a* through 53*c* to inlets 54*a* through 54*c* of three coathanger die cavities 55*a* through 55*c* arranged in a side-by-side relationship in die body 56. Each die cavity includes a manifold such as manifold 57*a*. The dies share a common slot 58. The fiber-forming material streams delivered to the meltblowing die cavities 55*a* through 55*c* all have a similar thermal history, thus promoting the formation of a nonwoven web of entangled fibers having substantially uniform fiber physical or chemical properties on moving collector (not shown in FIG. 5).

Figure 6:
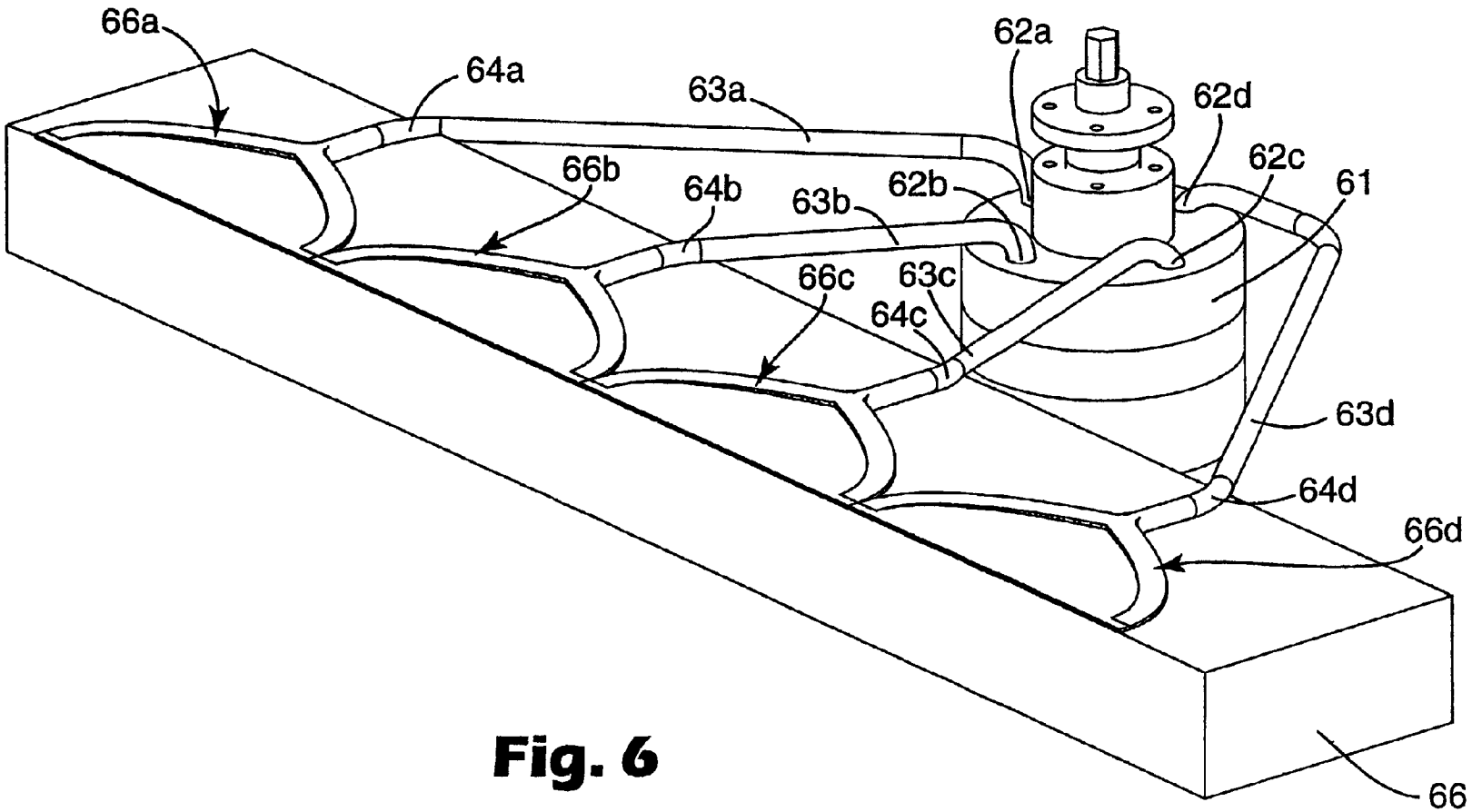
FIG. 6 is a schematic perspective view, partially in section, of a meltblowing die incorporating a planetary gear metering pump and an array of substantially uniform residence time meltblowing die cavities in a side-by-side relationship.

FIG. 6 shows a top sectional view of a substantially uniform residence time meltblowing apparatus 60 that has particular utility for use in a meltblowing system of the invention. Apparatus 60 includes a planetary gear metering pump 61 whose four outlets 62*a* through 62*d* located at the top of pump 61 supply fiber-forming material via conduits 63*a* through 63*d* to inlets 64*a* through 64*d* of four die cavities 66*a* through 66*d* arranged in a side-by-side relationship in die body 66. Fiber-forming material flows from the outlets of pump 61 through the die body inlets and thence through each die cavity as described in more detail below.

Figure 7A:
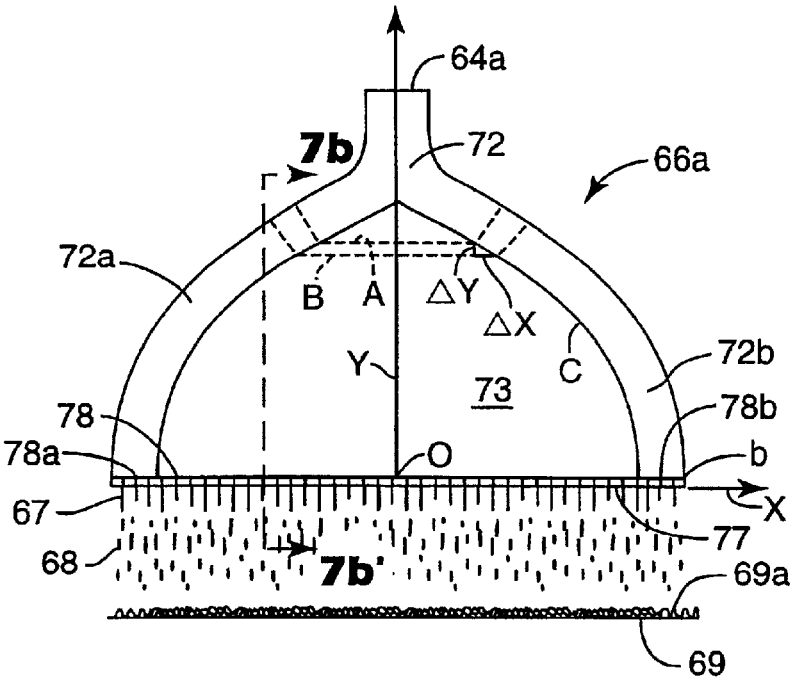
FIG. 7*a* is top sectional view of a die cavity of FIG. 6.

FIG. 7*a* shows a schematic top sectional view of die cavity 66*a* of FIG. 6. Fiber-forming material enters die body 66 via inlet 64*a* and flows through manifold 72 along manifold arm 72*a* or 72*b*. Manifold arms 72*a* and 72*b* preferably have a constant width and variable depth. Some of the fiber-forming material exits die cavity 66*a* by passing through manifold arm 72*a* or 72*b* and through orifices such as orifice 78*a* or 78*b* machined or drilled in die tip 77. The remaining fiber-forming material exits die cavity 66*a* by passing from manifold arm 72*a* or 72*b* into slot 73 and through orifices such as orifice 78 in die tip 77. The exiting fiber-forming material produces a series of filaments 67. A plurality of high velocity attenuating fluid streams supplied under pressure from orifices (not visible in FIG. 3) near die tip 77 attenuate the filaments 67 into fibers 68. The fibers 68 are collected at random on a remotely-located collector such as a moving screen 69 or other suitable surface to form a coherent entangled nonwoven web 69*a*.

Figure 7B:
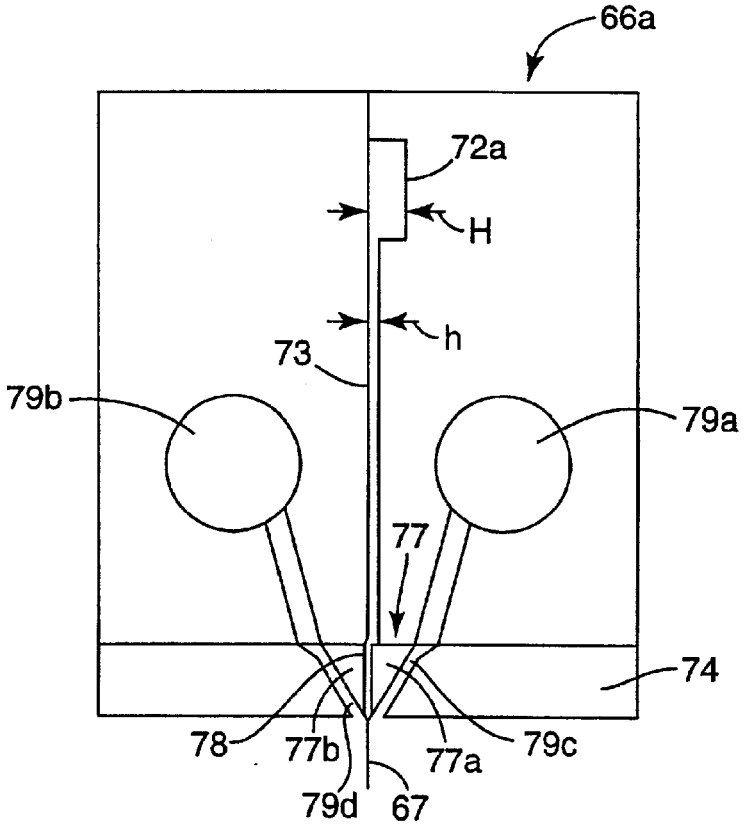
FIG. 7*b* is a side sectional view of the die of FIG. 7*a*, taken along the line 7*b*–7*b'*.

FIG. 7*b* shows a cross-sectional view of the die 48 of FIG. 3, taken along the line 7*b*–7*b*'. Manifold arm 72*a* has a variable depth H that ranges from a maximum near inlet 64*a* to a minimum near the ends of manifold arms 72*a* and 72*b*. Slot 73 has fixed depth h. Fiber-forming material passes from manifold arm 72*a* into slot 73 and exits die cavity 66*a* through orifice 78 in die tip 77 as filament 67. Air knife 74 overlays die tip 77. Die tip 77 is removable and preferably is split into two matching halves 77*a* and 77*b*, permitting ready alteration in the size, arrangement and spacing of the orifices 78. A pressurized stream of attenuating fluid can be supplied from plenums 79*a* and 79*b* in the exit face of die cavity 66*a* through orifices 79*c* and 79*d* in air knife 74 to attenuate the extruded filaments 67 into fibers.

Figure 7C:
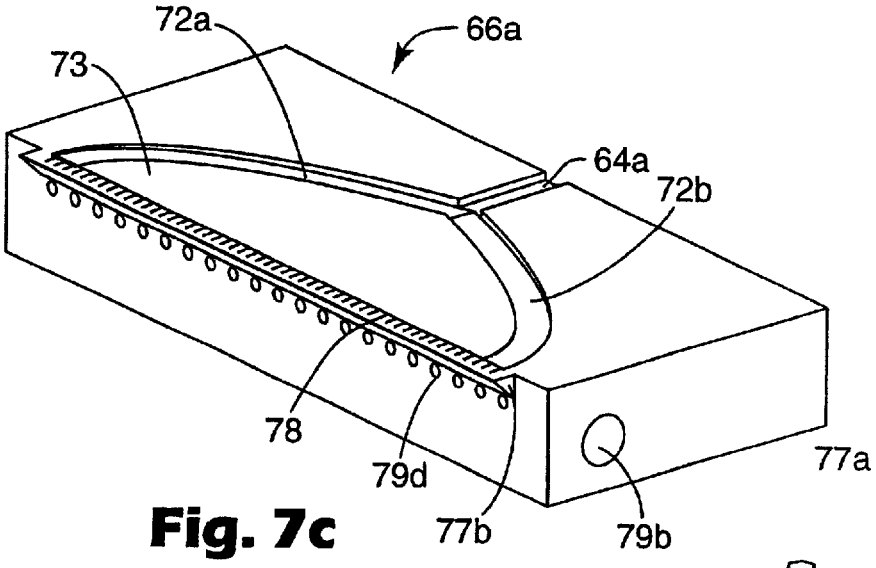
FIG. 7*c* is a schematic perspective sectional view of the die of FIG. 7*a*.

FIG. 7*c* shows a perspective sectional view of meltblowing die 48. For clarity, only the lower half 77*b* of die tip 77 is shown, and air knife 74 has been omitted from FIG. 7*c*. The remaining elements of FIG. 7*c* are as in FIG. 7*a* and FIG. 7*b*.

Die cavities such as die cavity 66*a* may be designed with the aid of equations discussed in more detail below and in copending application Ser. No. 10/177,446 entitled "NONWOVEN WED DIE AND NONWOVEN WEBS MADE THEREWITH", filed Jun. 20, 2002, the disclosure of which is incorporated herein by reference. The equations can provide an optimized nonwoven die cavity design having a uniform residence time for fiber-forming material passing through the die cavity. The filaments exiting such a die cavity preferably have uniform physical or chemical properties after they have been attenuated, collected and cooled to form a nonwoven web.

In comparison to the die cavities illustrated in FIG. 1 and FIG. 2, die 66*a* of FIG. 7*a* is much deeper from the fiber-forming material inlet to the filament outlet for a given die cavity width. Die cavities such as die cavity 66*a* may be scaled to a variety of sizes to form nonwoven webs of various desired web widths However, forming wide webs (e.g., widths of about one-half meter or more) from a single such meltblowing die would require a very deep die cavity that could exhibit excessive pressure drop. Wide webs of the invention preferably have widths of 0.5, 1, 1.5 or even 2 meters or more and preferably are formed using a plurality of die cavities arranged to provide a wider web than would be obtained using only a single such die cavity. For example, when using a nonwoven die of the invention that is substantially planar, then a plurality of die cavities preferably are arranged in a side-by-side relationship as shown, for example, in FIG. 6. A die such as that shown in FIG. 6 enables the arrangement of a plurality of narrow die cavities (having, for example, widths less than 0.5, less than 0.33, less than 0.25 or less than 0.1 meters) in a side-by-side array that may form uniform or substantially uniform nonwoven webs having widths of one meter or more. Compared to the use of a single wider and deeper die cavity, the use of a plurality of side-by side die cavities may reduce the overall depth of the die from front to back, may reduce the pressure drop from the die inlet to the die outlet and may reduce die lip deflection along the width of the die.

Figure 8:
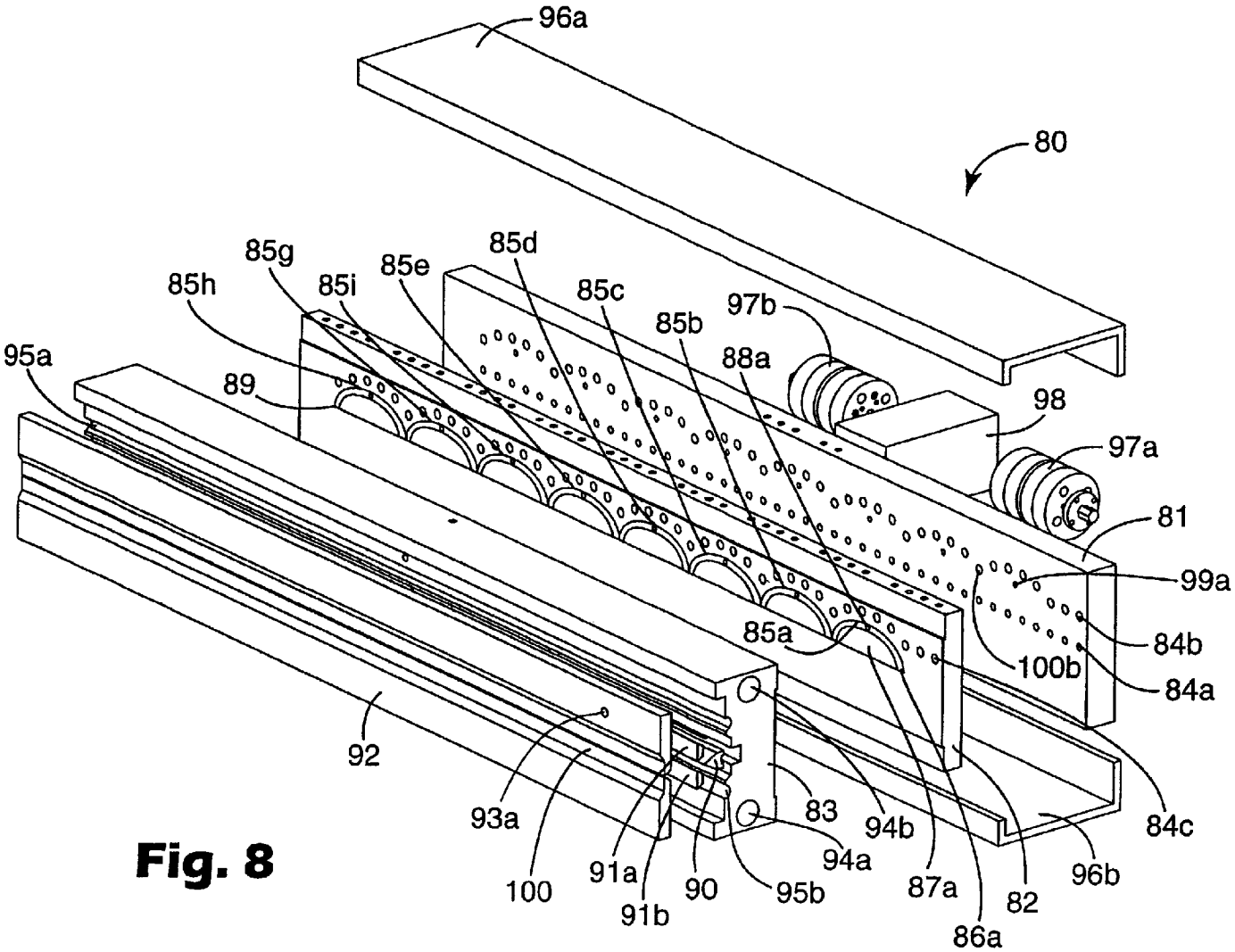
FIG. 8 is an exploded view of another meltblowing die incorporating a planetary gear metering pump.

In a preferred embodiment of the invention, the die cavity outlet is angled away from the plane of the die slot. FIG. 8 shows an exploded perspective view of one such configuration for a meltblowing die 80. Die 80 includes upright base 81 which is fastened to die body 82 via bolts (not shown in FIG. 8) through bolt holes such as hole 84*a*. Die body 82 and base 81 are fastened to air manifold 83 via bolts (also not shown in FIG. 8) through bolt holes such as holes 84*b* and 84*c*. Die body 82 includes a contiguous array of eight die cavities 85*a* through 85*h* like that shown in FIG. 3, each of which preferably is machined to identical dimensions. Die cavities 85*a* through 85*h* share a common die land 89. Die cavity 85*a* includes manifold 86*a*, slot 87*a* and inlet port 88*a*. Similar components are found in die cavities 85*b* thorough 85*h*. Die tip 90 is held in place on air manifold 83 by clamps 91*a* and 91*b*. Air knife 92 is fastened to air manifold 83 via bolts (not shown in FIG. 8) through bolt holes such as hole 93*a*. Air manifold 83 includes inlet ports 94*a* and 94*b* through which air can be conducted via internal passages (not shown in FIG. 8) to plenums 95*a* and 95*b* and thence to air knife 92. Insulation pads 96*a* and 96*b* help maintain apparatus 80 at a uniform temperature. During operation of die 80, two 4-port planetary gear metering pumps 97*a* and 97*b* supply fiber-forming material through distribution chamber 98. The use of two pumps facilitates conversion of apparatus 80 to other configurations, e.g., as a die for extrusion of multilayer webs or for extrusion of bicomponent fibers. The fiber-forming material is conducted via internal passages (not shown in FIG. 8) in base 81 through ports such as port 99*a* and then through ports such as port 88*a* into die cavities 85*a* through 85*h*. After passing through the manifolds such as manifold 86*a* and through the die slots such as slot 87*a*, the fiber-forming material passes over die land 89 and makes a right angle turn into a slit (not shown in FIG. 8) in air manifold 83. Because of the arrangement of components and parting lines in die 80, die cavities 85*a* through 85*h* are surrounded by machined metal surfaces of ample width that can be firmly clamped to base 81 and air manifold 83. Normally, it would be difficult to place heat input devices in some regions of a die design like that shown in FIG. 8. However, for reasons explained in more detail below, such a die design preferably can be operated with reduced reliance on such heat input devices. This provides greater flexibility in the overall die design and enables the major components, machined surfaces and parting lines in the die to be arranged in a configuration that can be repeatedly assembled and disassembled for cleaning while reducing the likelihood of wear-induced leakage.

The slit in air manifold 83 conducts the fiber-forming material to orifices drilled or machined in tip 90 whereupon the fiber-forming material exits die 80 as a series of small diameter filaments. Meanwhile, air entering air manifold 83 through ports 94*a* and 94*b* impinges upon the filaments, attenuating them into fibers as or shortly after they pass through slit 100 in air knife 92.

Figure 9:
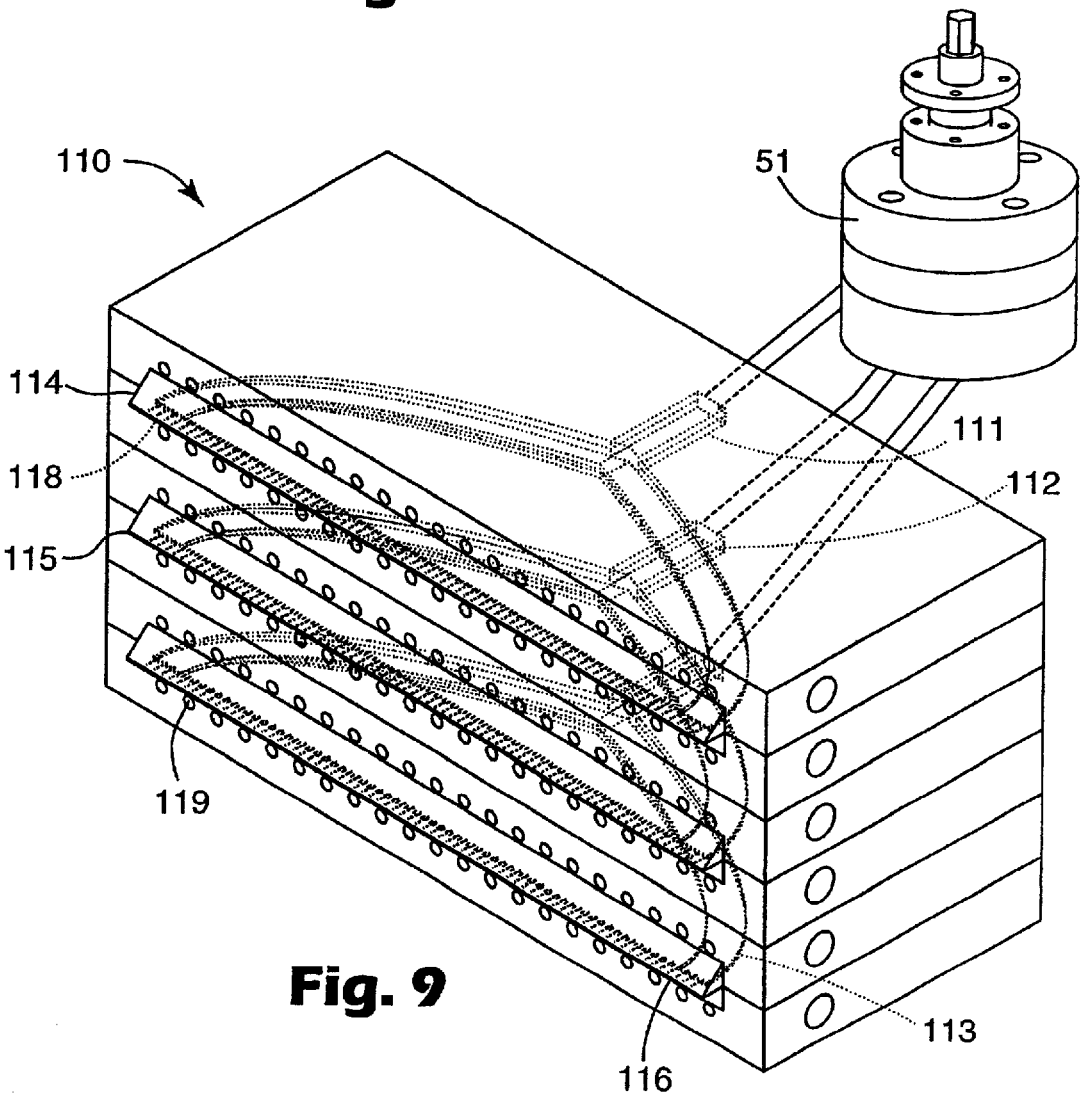
FIG. 9 is a schematic perspective view, partially in phantom, of a meltblowing die incorporating a planetary gear metering pump connected to an array of meltblowing die cavities in a vertically stacked relationship.

Die cavities having shapes like the tee slot, coathanger and fishtail die cavities shown above or die cavities such as die cavity 66*a* of FIG. 7*a* may also be arranged to provide a thicker web than would be obtained using only a single such die cavity. For example, when using nonwoven dies that are substantially planar, then a plurality of such die cavities preferably are arranged in a stack to form thick webs. FIG. 9 illustrates a meltblowing system 110 of the invention incorporating a vertical stack of die cavities 111, 112 and 113. System 110 includes a planetary gear metering pump 51 whose three outlets located at the bottom of pump 51 (not shown in FIG. 9) supply fiber-forming material via conduits 53*a* through 53*c* to inlets die cavities 111, 112 and 113. For clarity, die tips 114, 115 and 116 are shown without the overlying air knives that would direct attenuating fluid from orifices such as orifice 119 onto the filaments exiting orifices such as orifice 118 in die tip 114. Die 110 may be used to form three contiguous nonwoven web layers each containing a layer of entangled, attenuated melt blown fibers.

Those skilled in the art will appreciate that the meltblowing die does not need to be planar. A meltblowing apparatus of the invention can employ an annular die having a central axis of symmetry, for forming a cylindrical array of filaments. A die having a plurality of nonplanar (curved) die cavities whose shape if made planar would be like that shown in FIG. 7*a* can also be arranged around the circumference of a cylinder to form a larger diameter cylindrical array of filaments than would be obtained using only a single annular die cavity of similar die depth. A plurality of nested annular nonwoven dies of the invention can also be arranged around a central axis of symmetry to form a multilayered cylindrical array of filaments.

Preferred meltblowing dies for use in the invention can be designed using fluid flow equations based on the behavior of a power law fluid obeying the equation:

$$\eta=\eta^{o}\gamma^{n-1} \tag{1}$$

where:

$\eta$=viscosity $\eta^{o}$=the reference viscosity at a reference shear rate $\gamma^{0}$ n=power law index $\gamma$=shear rate Referring again to FIG. 7*a*, an x-y coordinate axis has been overlaid upon die cavity 66*a*, with the x-axis corresponding generally to the die cavity outlet edge (or in other words, the inlet side of die tip 77) and the y-axis corresponding generally to the centerline of die cavity 66*a*. Die cavity 66*a* has a half width of dimension b and an overall width of dimension 2·b. The fluid flow rate $Q_m(x)$ in the manifold at position x can be assumed for mass balance reasons to equal the flow rate of material exiting the die cavity between positions x and b, and can also be assumed to equal the average velocity of the fluid in the manifold times the cross-sectional area of the manifold arm:

$$Q_m(x)=(b-x)h\bar{v}_s=WH(x)\bar{v}_m \tag{2}$$

where:

$Q_m(x)$ is the fluid flow rate in the manifold arm at position x $\bar{v}_m$ is the average fluid velocity in the manifold arm b is the half width of the die cavity $\bar{v}_s$ is the average fluid velocity in the slot h is the slot depth H(x) is the manifold arm depth at position x W is the manifold arm width.

The manifold arm width is assumed to be some appreciable dimension, e.g., a width of 1 cm, 1.5 cm, 2 cm, etc. A value for the slot depth h can be chosen based on the range of rheologies of the fiber-forming fluids that will flow through the die cavity and the targeted pressure drop across the die. The fluid flow in the manifold is assumed to be nonturbulent and occurring in the direction of the manifold arm. The fluid flow in the slot is assumed to be laminar and occurring in the −y direction. The dotted lines A and B in FIG. 7*a* represent lines of constant pressure, normal to the fluid flow direction. The pressure gradient in the slot is related to the pressure gradient in the manifold arm by the equation:

$$\left(\frac{dp}{dy}\right)_{slot}=\left(\frac{dp}{dt}\right)_{manifold\ arm}\left(\frac{\Delta\zeta}{\Delta y}\right) \tag{3}$$

where $\Delta\zeta$ is the hypotenuse of the triangle formed by $\Delta x$ and $\Delta y$, shown in FIG. 7*a* where dotted lines A and B intersect the contour line C between right-hand manifold arm 72*b* and slot 73. The equation:

$$\Delta\zeta=\Delta y\left[1+\left(\frac{dy}{dx}\right)^{2}\right]^{1/2} \tag{4}$$

can be found using the Pythagorean rule. The derivative dx/dy is the inverse of the slope of the contour line C. Combining equations (3) and (4) gives:

$$\frac{dy}{dx}=\left[\left[\left(\frac{dp}{dy}\right)_{slot}\Big/\left(\frac{dp}{d\zeta}\right)_{manifold}\right]^{2}-1\right]^{1/2}. \tag{5}$$

The fluid pressure gradient $\Delta p$ and shear $\gamma_w$ at the die cavity wall can be calculated by assuming steady flow in both the slot and manifold, and neglecting the influence of any fluid exchange. Assuming that the fluid obeys the power law model of viscosity:

$$n=n^{o}\left|\frac{\gamma}{\gamma^{o}}\right|^{n-1} \tag{6}$$

the pressure gradient and shear at the wall can be calculated for the slot as:

$$\Delta p=\frac{(-2n^{o}\gamma^{o})}{n}\left(\frac{-\gamma_w}{\gamma^{o}}\right)^{n} \tag{7}$$

$$\gamma_w=-\left(\frac{1}{n}+2\right)\frac{2\bar{v}}{h}. \tag{8}$$

An additional boundary condition is set by assuming that the shear rate at the wall of the slot will be the same as the shear rate at the wall of the manifold:

$$\gamma_s=\gamma_m \text{ at the wall.} \tag{9}$$

This makes the design independent of melt viscosity and requires that the viscosity be the same everywhere in the die cavity, at least at the wall. Requiring a uniform shear rate at the wall of both the manifold and slot, and requiring conservation of mass, gives the equation:

$$H=h\left(\frac{b-x}{W}\right)^{1/2} \tag{10}$$

and an equation for the slope of the manifold arm contour C:

$$\frac{dy}{dx}=-\left(\frac{b-x}{W}-1\right)^{1/2} \tag{11}$$

which can be integrated to find:

$$y(x)=2W\left(\frac{b-x}{W}-1\right)^{1/2}. \tag{12}$$

Equation (12) can be used to design the contour of the manifold arm.

The manifold arm depth H(x) can be calculated using the equation:

$$H(x) = \left(\frac{b-x}{W}\right)^{1/2}. \tag{13}$$

A die cavity designed using the above equations can have a uniform residence time, as can be seen by dividing the numerator and denominator of equation (3) by Δt to yield the equation:

$$\frac{dp}{dy} = \frac{dp\left(\frac{\Delta\zeta}{\Delta t}\right)}{d\zeta\left(\frac{\Delta y}{\Delta t}\right)}. \tag{14}$$

Equation (14) can be manipulated to give:

$$\frac{dp}{dy} = \frac{-1}{\left[\left(\frac{\bar{v}_m}{\bar{v}_s}\right)^2 - 1\right]^{1/2}} \tag{15}$$

which through further manipulation leads to:

$$\Delta t = \frac{\Delta y}{\bar{v}_s} = \frac{\Delta\zeta}{\bar{v}_m}. \tag{16}$$

The residence time in the manifold is accordingly the same as the residence time in the slot. Thus along any path, the fluid experiences not only the same shear rate but also experiences that rate for the same length of time. This promotes a relatively uniform thermal and shear history for the fiber-forming material stream across the width of the die cavity.

Those skilled in the art will appreciate that the above-described equations provide an optimized die cavity design. An optimized die cavity design, while desirable, is not required to obtain the benefits of the invention. Deliberate or accidental variation from the optimized design parameters provided by the equations can still provide a useful die cavity design having substantially uniform residence time. For example, the value for y(x) provided by equation (12) may vary, e.g., by about ±50%, more preferably by about ±25%, and yet more preferably by about ±10% across the die cavity. Expressed somewhat differently, the die cavity manifold arms and die slot can meet within curves defined by the equation:

$$y(x) = (1 \pm 0.5)2W\left(\frac{b-x}{W} - 1\right)^{1/2} \tag{17}$$

and more preferably within curves defined by the equation:

$$y(x) = (1 \pm 0.25)2W\left(\frac{b-x}{W} - 1\right)^{1/2} \tag{18}$$

and yet more preferably within curves defined by the equation:

$$y(x) = (1 \pm 0.1)2W\left(\frac{b-x}{W} - 1\right)^{1/2} \tag{19}$$

where x, y, b and W are as defined above.

Those skilled in the art will also appreciate that residence time does not need to be perfectly uniform across the die cavity. For example, as noted above the residence time of fiber-forming material streams within the die cavity need only be substantially uniform. More preferably, the residence time of such streams is within about ±50% of the average residence time, more preferably within about ±10% of the average residence time. A tee slot die or coathanger die typically exhibits a much larger variation in residence time across the die. For tee slots dies, the residence time may vary by as much as 200% or more of the average value, and for coathanger dies the residence time may vary by as much as 1000% or more of the average value.

Those skilled in the art will also appreciate that the above-described equations were based upon a die cavity design having a manifold with a rectangular cross-sectional shape, constant width and regularly varying depth. Suitably configured manifolds having other cross-sectional shapes, varying widths or other depths might be substituted for the design shown in FIG. 7*a* and still provide uniform or substantially uniform residence time throughout the die cavity. Similarly, those skilled in the art will appreciate that the above-described equations were based upon a die cavity design having a slot of constant depth. Suitably configured die cavity designs having slots with varying depths might be substituted for the design shown in FIG. 7*a* and still provide uniform or substantially uniform residence time throughout the die cavity. In each case the equations will become more complicated but the underlying principles described above can still apply.

For meltblowing systems incorporating die cavities like the design shown in FIG. 7*a*, the shear rate at the die cavity wall and the shear stress experienced by the flowing fiber-forming material can be the same or substantially the same for any point on the wetted surface of the die cavity wall. This can make meltblowing systems incorporating a planetary gear metering pump and such die cavities relatively insensitive to alteration in the viscosity or mass flow rate of the fiber-forming material, and can enable such meltblowing systems to be used with a wide variety of fiber-forming materials and under a wide variety of operating conditions. This also can enable such meltblowing systems to accommodate changes in such conditions during operation of the system. Preferred meltblowing systems of the invention can be used with viscoelastic, shear sensitive and power law fluids. Preferred meltblowing systems of the invention may also be used with reactive fiber-forming materials or with fiber-forming materials made from a mixture of monomers, and may provide uniform reaction conditions as such materials or monomers pass through the die cavity. When cleaned using purging compounds, the constant wall shear stress provided by such preferred meltblowing systems may promote a uniform scouring action throughout the die cavity, thus facilitating thorough and even cleaning action.

It may be preferred to supply identical streams of attenuating fluid to each extruded filament. In such cases, the attenuating fluid preferably is supplied using an adjustable attenuating fluid manifold as described in copending application Ser. No. 10/177,814 entitled "ATTENUATING FLUID MANIFOLD FOR MELTBLOWING DIE", filed Jun. 20, 2002, the disclosure of which is incorporated herein by reference.

Preferred meltblowing systems of the invention may be operated using a flat temperature profile, with reduced reliance on adjustable heat input devices (e.g., electrical heaters mounted in the die body) or other compensatory measures to obtain uniform output. This may reduce thermally generated stresses within the die body and may discourage die cavity deflections that could cause localized basis weight nonuniformity. Heat input devices may be added to the dies of the invention if desired. Insulation may also be added to assist in controlling thermal behavior during operation of the die.

Preferred meltblowing systems of the invention can produce highly uniform webs. If evaluated using a series (e.g., 3 to 10) of 0.01 $m^2$ samples cut from the near the ends and middle of a web (and sufficiently far away from the edges to avoid edge effects), preferred meltblowing systems of the invention may provide nonwoven webs having basis weight uniformities of ±2% or better, or even ±1% or better. Using similarly-collected samples, preferred meltblowing systems of the invention may provide nonwoven webs comprising at least one layer of melt blown fibers whose polydispersity differs from the average fiber polydispersity by less than ±5%, more preferably by less than ±3%.

A variety of synthetic or natural fiber-forming materials may be made into nonwoven webs using the meltblowing systems of the invention. Preferred synthetic materials include polyethylene, polypropylene, polybutylene, polystyrene, polyethylene terephthalate, polybutylene terephthalate, linear polyamides such as nylon 6 or nylon 11, polyurethane, poly (4-methyl pentene-1), and mixtures or combinations thereof. Preferred natural materials include bitumen or pitch (e.g., for making carbon fibers). The fiber-forming material can be in molten form or carried in a suitable solvent. Reactive monomers can also be employed in the invention, and reacted with one another as they pass through the pump or into or through the die. The nonwoven webs may contain a mixture of fibers in a single layer (made for example, using two closely spaced die cavities sharing a common die tip), a plurality of layers (made for example, using a die such as shown in FIG. 7), or one or more layers of multicomponent fibers (such as those described in U.S. Pat. No. 6,057,256).

The fibers in nonwoven webs made using the meltblowing systems of the invention may have a variety of diameters. For example, the fibers may be ultrafine fibers averaging less than 5 or even less than 1 micrometer in diameter; microfibers averaging less than about 10 micrometers in diameter; or larger fibers averaging 25 micrometers or more in diameter.

The nonwoven webs made using the meltblowing systems of the invention may contain additional fibrous or particulate materials as described in, e.g., U.S. Pat. Nos. 3,016,599, 3,971,373 and 4,111,531. Other adjuvants such as dyes, pigments, fillers, abrasive particles, light stabilizers, fire retardants, absorbents, medicaments, etc., may also be added to the nonwoven webs. The addition of such adjuvants may be carried out by introducing them into the fiber-forming material stream, spraying them on the fibers as they are formed or after the nonwoven web has been collected, by padding, and using other techniques that will be familiar to those skilled in the art. For example, fiber finishes may be sprayed onto the nonwoven webs to improve hand and feel properties.

The completed nonwoven webs may vary widely in thickness. For most uses, webs having a thickness between about 0.05 and 15 centimeters are preferred. For some applications, two or more separately or concurrently formed nonwoven webs may be assembled as one thicker sheet product. For example, a laminate of spun bond, melt blown and spun bond fiber layers (such as the layers described in U.S. Pat. No. 6,182,732) can be assembled in an SMS configuration. Nonwoven webs may also be prepared using the meltblowing systems of the invention by depositing the stream of fibers onto another sheet material such as a porous nonwoven web that will form part of the completed web. Other structures, such as impermeable films, may be laminated to the nonwoven webs through mechanical engagement, heat bonding, or adhesives.

The nonwoven webs may be further processed after collection, e.g., by compacting through heat and pressure to cause point bonding, to control sheet caliper, to give the web a pattern or to increase the retention of particulate materials. The nonwoven webs may be electrically charged to enhance their filtration capabilities as by introducing charges into the fibers as they are formed, in the manner described in U.S. Pat. No. 4,215,682, or by charging the web after formation in the manner described in U.S. Pat. No. 3,571,679.

The nonwoven webs made using the meltblowing systems of the invention may have a wide variety of uses, including filtration media and filtration devices, medical fabrics, sanitary products, oil adsorbents, apparel fabrics, thermal or acoustical insulation, battery separators and capacitor insulation.

Various modifications and alterations of this invention will be apparent to those skilled in the art without departing from the scope and spirit of this invention. This invention should not be restricted to that which has been set forth herein only for illustrative purposes.

What is claimed is:

1. A method for forming a fibrous web comprising supplying fiber-forming material to a planetary gear metering pump having a plurality of outlets, flowing fiber-forming material from the pump outlets through a plurality of inlets in one or more die cavities, and meltblowing the fiber-forming material to form a nonwoven web.

2. A method according to claim 1 wherein the fiber-forming material has the same or substantially the same physical or chemical properties as it enters each inlet.

3. A method according to claim 1 wherein a plurality of the pump outlets are connected to a single die cavity.

4. A method according to claim 1 wherein each pump outlet is connected to a die cavity.

5. A method according to claim 1 wherein the pump has three or more outlets and there are three or more die cavities.

6. A method according to claim 1 wherein a plurality of such pump outlets and die cavities are arranged to form a wider or thicker web than would be obtained using only a single such die cavity.

7. A method according to claim 1 wherein a plurality of such pump outlets and die cavities having widths less than about 0.5 meters are arranged in a side-by-side array that can form a uniform or substantially uniform nonwoven web having a width of about one meter or more.

8. A method according to claim 1 wherein a plurality of such pump outlets and die cavities having widths less than about 0.33 meters are arranged in a side-by-side array that can form a uniform or substantially uniform nonwoven web having a width of about one meter or more.

9. A method according to claim 1 wherein a plurality of such pump outlets and die cavities having widths less than about 0.25 meters are arranged in a side-by-side array that can form a uniform or substantially uniform nonwoven web having a width of one meter or more.

10. A method according to claim 1 wherein the nonwoven web has a width greater than about 0.5 meters.

11. A method according to claim 1 wherein the nonwoven web has a width greater than about 1 meter.

12. A method according to claim 1 wherein the nonwoven web has a width greater than about 2 meters.

13. A method according to claim 1 wherein fiber-forming material flows from such pump outlets to a plurality of such die cavities arranged in a stack.

14. A method according to claim 1 wherein the die cavity is part of an annular die having a central axis of symmetry.

15. A method according to claim 1 wherein the die cavity can be operated using a flat temperature profile.

16. A method according to claim 1 wherein the die cavity has a generally planar die slot and an outlet and the die cavity outlet is angled away from the plane of the die slot.

17. A method according to claim 1 wherein the die cavity has a manifold having a wall and a die slot having a wall, and the shear rate at the slot wall is substantially the same as the shear rate at the manifold wall.

18. A method according to claim 1 wherein the die cavity has an outlet edge and a centerline, and further has manifold arms and a die slot that meet within curves defined by the equation:

$$y(x) = (1 \pm 0.5)2W\left(\frac{b-x}{W} - 1\right)^{1/2}$$

where x and y are coordinates in an x-y coordinate space in which the x-axis corresponds to the outlet edge and the y-axis corresponds to the centerline, b is the die cavity half-width and W is the manifold arm width.

19. A method according to claim 18 wherein the manifold arms and die slot meet within curves defined by the equation $$y(x) = (1 \pm 0.1)2W\left(\frac{b-x}{W} - 1\right)^{1/2}.$$

20. A method according to claim 1 wherein the nonwoven web comprises fibers whose polydispersity differs from the average fiber polydispersity by less than ±5%.

21. A method according to claim 1 wherein the nonwoven web has a basis weight uniformity of about ±2% or better.

22. A meltblowing apparatus comprising a planetary gear metering pump having a plurality of fiber-forming material outlets connected to a plurality of fiber-forming material inlets in one or more die cavities of one or more meltblowing dies.

23. An apparatus according to claim 22 wherein the fiber-forming material has the same or substantially the same physical or chemical properties as it enters each inlet.

24. An apparatus according to claim 22 wherein a plurality of the pump outlets are connected to a single die cavity of a meltblowing die.

25. An apparatus according to claim 22 wherein each pump outlet is connected to a die cavity.

26. An apparatus according to claim 22 the pump has three or more outlets and there are three or more die cavities.

27. An apparatus according to claim 22 wherein a plurality of such pump outlets and die cavities are arranged to form a wider or thicker web than would be obtained using only a single such die cavity.

28. An apparatus according to claim 27 wherein a plurality of such pump outlets and die cavities having widths less than about 0.5 meters are arranged in a side-by-side array that can form a uniform or substantially uniform nonwoven web having a width of about one meter or more.

29. An apparatus according to claim 22 wherein a plurality of such pump outlets and die cavities having widths less than about 0.33 meters are arranged in a side-by-side array that can form a uniform or substantially uniform nonwoven web having a width of about one meter or more.

30. An apparatus according to claim 22 wherein a plurality of such pump outlets and die cavities having widths less than about 0.25 meters are arranged in a side-by-side array that can form a uniform or substantially uniform nonwoven web having a width of one meter or more.

31. An apparatus according to claim 22 wherein the apparatus can form a nonwoven web having a width greater than about 0.5 meters.

32. An apparatus according to claim 22 wherein the apparatus can form a nonwoven web having a width greater than about 1 meter.

33. An apparatus according to claim 22 wherein the apparatus can form a nonwoven web having a width greater than about 2 meters.

34. An apparatus according to claim 22 wherein a plurality of such die cavities are arranged in a stack.

35. An apparatus according to claim 22 wherein the die cavity is part of an annular die having a central axis of symmetry.

36. An apparatus according to claim 22 wherein the die cavity can be operated using a flat temperature profile.

37. An apparatus according to claim 22 comprising a die cavity having a generally planar die slot and an outlet and wherein the die cavity outlet is angled away from the plane of the die slot.

38. An apparatus according to claim 37 wherein the die cavity outlet is angled away from the plane of the die slot at approximately a right angle.

39. An apparatus according to claim 22 comprising a die cavity having a manifold having a wall and a die slot having a wall, and wherein the shear rate at the slot wall is substantially the same as the shear rate at the manifold wall.

40. An apparatus according to claim 22 comprising a die cavity having an outlet edge and a centerline, and further having manifold arms and a die slot that meet within curves defined by the equation:

$$y(x) = (1 \pm 0.5)2W\left(\frac{b-x}{W} - 1\right)^{1/2}$$

where x and y are coordinates in an x-y coordinate space in which the x-axis corresponds to the outlet edge and the y-axis corresponds to the centerline, b is the die cavity half-width and W is the manifold arm width.

41. An apparatus according to claim 40 wherein the manifold arms and die slot meet within curves defined by the equation $$y(x) = (1 \pm 0.1)2W\left(\frac{b-x}{W} - 1\right)^{1/2}.$$

42. An apparatus according to claim 22 wherein the residence time experienced by the fiber-forming material as it flows through the pump and meltblowing die are such that the apparatus can form a nonwoven web comprising fibers whose polydispersity differs from the average fiber polydispersity by less than ±5%.

43. An apparatus according to claim 22 wherein the residence time experienced by the fiber-forming material as it flows through the pump and meltblowing die are such that the apparatus can form a nonwoven web having a basis weight uniformity of about ±2% or better.

* * * * *

UNITED STATES PATENT AND TRADEMARK OFFICE

CERTIFICATE OF CORRECTION

PATENT NO. : 6,824,733 B2
DATED : November 30, 2004
INVENTOR(S) : Erickson, Stanley C.

It is certified that error appears in the above-identified patent and that said Letters Patent is hereby corrected as shown below:

Column 4,
Line 62, after "example" delete "." and insert -- , --, therefor.

Column 5,
Line 2, delete "3,498.230" and insert -- 3,498,230 --, therefor.
Line 20, delete "chinned" and insert -- thinned -- therefor.
Line 29, delete "pans" and insert -- parts -- therefor.

Colmn 7,
Line 23, delete "WED" and insert -- WEB -- therefor.

Signed and Sealed this

First Day of February, 2005

JON W. DUDAS
*Director of the United States Patent and Trademark Office*